US008473288B2

(12) United States Patent
Morii et al.

(10) Patent No.: US 8,473,288 B2
(45) Date of Patent: Jun. 25, 2013

(54) QUANTIZER, ENCODER, AND THE METHODS THEREOF

(75) Inventors: Toshiyuki Morii, Kanagawa (JP); Hiroyuki Ehara, Kanagawa (JP); Koji Yoshida, Kanagawa (JP)

(73) Assignee: Panasonic Corporation, Osaka (JP)

( * ) Notice: Subject to any disclaimer, the term of this patent is extended or adjusted under 35 U.S.C. 154(b) by 262 days.

(21) Appl. No.: 12/990,697

(22) PCT Filed: Jun. 18, 2009

(86) PCT No.: PCT/JP2009/002780
§ 371 (c)(1),
(2), (4) Date: Nov. 2, 2010

(87) PCT Pub. No.: WO2009/153995
PCT Pub. Date: Dec. 23, 2009

(65) Prior Publication Data

US 2011/0125495 A1 May 26, 2011

(30) Foreign Application Priority Data

Jun. 19, 2008 (JP) ..... 2008-161020

(51) Int. Cl.
*G10L 19/00* (2006.01)

(52) U.S. Cl.
USPC ..... 704/230; 704/203; 704/500

(58) Field of Classification Search
USPC ..... 704/501, 504, 230
See application file for complete search history.

(56) References Cited

U.S. PATENT DOCUMENTS 6,631,347 B1 10/2003 Kim et al.
7,359,522 B2 * 4/2008 Aarts et al. ..... 381/94.7

(Continued)

FOREIGN PATENT DOCUMENTS

JP 1-240032 9/1989
JP 2001-255892 9/2001

(Continued)

OTHER PUBLICATIONS

Virette, "Parametric Coding of Stereo Audio Based on Principal Component Analysis", Proc. of the Conference on Didital Audio Effects, XP002579979, Sep. 18, 2006.

(Continued)

*Primary Examiner* — Jialong He
*Assistant Examiner* — Jie Shan
(74) *Attorney, Agent, or Firm* — Greenblum & Bernstein, P.L.C.

(57) ABSTRACT

Disclosed are a quantizer, encoder, and the methods thereof, wherein the computational load is reduced when the values related to the transform coefficients of the principal component analysis transform are quantized when a principal component analysis transform is applied to code stereo. A quantizer includes a power correlation calculator which calculates the power of the left channel signal, the power of the right channel signal, and the correlation between the left channel signal and the right channel signal; an intermediate value calculator which calculates the intermediate value which is the difference between left channel signal the power and the right channel signal power; a codebook which holds a plurality of sets of the coefficients related to the transform coefficients of the principal component analysis transform and the code; and a quantizer which calculates the sum of the first multiplication result obtained by multiplying the coefficient by the correlation value and the second multiplication result obtained by multiplying the coefficient by the intermediate value as the cost function E, selects the coefficients where the cost function E becomes the maximum, and fetches the code related to the selected coefficients as the quantized code.

5 Claims, 4 Drawing Sheets

U.S. PATENT DOCUMENTS

| | | | | |
|---|---|---|---|---|
| 7,437,299 | B2 * | 10/2008 | Aarts et al. | 704/500 |
| 7,447,629 | B2 * | 11/2008 | Breebaart | 704/219 |
| 7,519,533 | B2 | 4/2009 | Ehara et al. | |
| 7,602,922 | B2 * | 10/2009 | Breebaart et al. | 381/23 |
| 7,646,875 | B2 * | 1/2010 | Schuijers et al. | 381/23 |
| 7,751,572 | B2 * | 7/2010 | Villemoes et al. | 381/23 |
| 7,797,162 | B2 * | 9/2010 | Yoshida et al. | 704/500 |
| 8,218,775 | B2 * | 7/2012 | Norvell et al. | 381/23 |
| 2005/0141721 | A1 * | 6/2005 | Aarts et al. | 381/16 |
| 2005/0213522 | A1 * | 9/2005 | Aarts et al. | 370/278 |
| 2006/0206323 | A1 * | 9/2006 | Breebaart | 704/230 |
| 2006/0233379 | A1 * | 10/2006 | Villemoes et al. | 381/23 |
| 2007/0174062 | A1 | 7/2007 | Mehrotra et al. | |
| 2008/0091419 | A1 * | 4/2008 | Yoshida et al. | 704/219 |
| 2008/0195397 | A1 * | 8/2008 | Myburg et al. | 704/500 |
| 2008/0243520 | A1 * | 10/2008 | Breebaart | 704/500 |
| 2009/0083044 | A1 * | 3/2009 | Briand et al. | 704/500 |
| 2009/0228266 | A1 | 9/2009 | Ehara et al. | |
| 2009/0228267 | A1 | 9/2009 | Ehara et al. | |
| 2009/0271184 | A1 * | 10/2009 | Goto et al. | 704/223 |
| 2009/0319281 | A1 * | 12/2009 | Baumgarte et al. | 704/501 |
| 2010/0106493 | A1 * | 4/2010 | Zhou et al. | 704/219 |
| 2011/0125495 | A1 * | 5/2011 | Morii et al. | 704/230 |
| 2012/0063604 | A1 * | 3/2012 | Myburg et al. | 381/22 |

FOREIGN PATENT DOCUMENTS

| | | |
|---|---|---|
| JP | 2004-29708 | 1/2004 |
| JP | 2005-522721 | 7/2005 |
| WO | 03/085643 | 10/2003 |
| WO | WO03085643 A1 * | 10/2003 |
| WO | 2007/087117 | 8/2007 |
| WO | 2007/104883 | 9/2007 |

OTHER PUBLICATIONS

Search report from E.P.O., mail date is Apr. 19, 2012.

Briand et al., "Parametric Coding of Stereo Audio Based on Principal Component Analysis", Proc. of the 9th International Conference on Digital Audio Effects (DAFx-06), pp. DAFX-291 to DAFX-296, Sep. 18-20, 2006.

Yang et al., "High-Fidelity Multichannel Audio Coding With Karhunen-Loeve Transform", IEEE Transactions on Speech and Audio Processing, , pp. 365-380, vol. 11, No. 4, Jul. 2003.

U.S. Appl. No. 12/990,706 to Zongxian Liu et al.., filed Nov. 2, 2010.

* cited by examiner

| $\gamma_{1,n}$ , $\gamma_{2,n}$ | NUMBER (QUANTIZATION CODE) | $W_1$ , $W_2$ |
|---|---|---|
| g11,g12 | 000 | $\omega 11, \omega 12$ |
| g21,g22 | 001 | $\omega 21, \omega 22$ |
| g31,g32 | 010 | $\omega 31, \omega 32$ |
| g41,g42 | 011 | $\omega 41, \omega 42$ |
| g51,g52 | 100 | $\omega 51, \omega 52$ |
| g61,g62 | 101 | $\omega 61, \omega 62$ |
| g71,g72 | 110 | $\omega 71, \omega 72$ |
| g81,g82 | 111 | $\omega 81, \omega 82$ |

FIG.2

| ROTATION ANGLE | QUANTIZATION CODE |
|---|---|
| $\alpha 1$ | 000 |
| $\alpha 2$ | 001 |
| $\alpha 3$ | 010 |
| $\alpha 4$ | 011 |
| $\alpha 5$ | 100 |
| $\alpha 6$ | 101 |
| $\alpha 7$ | 110 |
| $\alpha 8$ | 111 |

FIG.4A

| ROTATION ANGLE | QUANTIZATION CODE | $W_1$ , $W_2$ |
|---|---|---|
| $\alpha 1$ | 000 | $\omega 11, \omega 12$ |
| $\alpha 2$ | 001 | $\omega 21, \omega 22$ |
| $\alpha 3$ | 010 | $\omega 31, \omega 32$ |
| $\alpha 4$ | 011 | $\omega 41, \omega 42$ |
| $\alpha 5$ | 100 | $\omega 51, \omega 52$ |
| $\alpha 6$ | 101 | $\omega 61, \omega 62$ |
| $\alpha 7$ | 110 | $\omega 71, \omega 72$ |
| $\alpha 8$ | 111 | $\omega 81, \omega 82$ |

FIG.4B

QUANTIZER, ENCODER, AND THE METHODS THEREOF

TECHNICAL FIELD

The present invention relates to a quantizing apparatus that quantizes a value related to transformation coefficients upon performing stereo coding using principal component analysis transformation, an encoding apparatus that performs stereo coding using the transformation coefficients, and quantizing and encoding methods.

BACKGROUND ART

Speech coding is generally used for communication applications using narrowband speech of the telephone band (200 Hz to 3.4 kHz). Narrowband speech codec of monaural speech is widely used in communication applications including speech communication through mobile phones, remote conference devices and recent packet networks (e.g. the Internet).

In recent years, with broadbandization of communication networks, there is a demand for realistic sensation in speech communication and high quality of music. To meet this demand, speech communication systems using stereo speech coding techniques have been developed.

As a method of encoding stereo speech, there is a known conventional method of finding a monaural signal to represent a sum of the left channel signal and the right channel signal, finding a side signal to represent the difference between the left channel signal and the right channel signal, and encoding the monaural signal and the side signal (see Patent Literature 1 and Patent Literature 2).

The left channel signal and the right channel signal represent sound heard by human ears, the monaural signal can represent the common part between the left channel signal and the right channel signal, and the side signal can represent the spatial difference between the left channel signal and the right channel signal.

There is a high correlation between the left channel signal and the right channel signal. Consequently, compared to the case of encoding the left channel signal and the right channel signal directly, it is possible to perform more suitable coding in accordance with features of a monaural signal and side signal by encoding the left channel signal and the right channel signal converted into a monaural signal and a side signal, so that it is possible to realize coding with less redundancy, low bit rate and high quality.

Patent Literature 2 discloses a method of transforming left channel signal L and right channel signal R of a stereo signal into monaural signal M and side signal S using two weight coefficients $W_1$ and $W_2$, as shown in equations 1-1 and 1-2.

[1]

$$y_{1,i}=W_1 \cdot x_{1,i}+W_2 \cdot x_{2,i} \quad \text{(Equation 1-1)}$$

$$y_{2,i}=-W_2 \cdot x_{1,i}+W_1 \cdot x_{2,i} \quad \text{(Equation 1-2)}$$

Also, in equations 1-1 and 1-2, $x_{1,i}$ represents left channel signal L, and $x_{2,i}$ represents right channel signal R. Also, $y_{1,i}$ represents monaural signal M, and $y_{2,i}$ represents side signal S. Also, i represents an index to represent time.

Left channel signal L and right channel signal R refer to signals to enter from the left and right sides of the human head and are highly correlated, so that it is possible to find a signal representing most of the left and right signals by monaural signal M and find a signal representing the spatial difference between the left and right signals by side signal S. Thus, by transforming left channel signal L and right channel signal R into monaural signal M and side signal S, it is possible to perform coding suitable to their features, and, compared to a case of encoding left channel signal L and right channel signal R directly, realize coding with less redundancy, low bit rate and high quality.

At this time, by setting two weight coefficients $W_1$ and $W_2$ to satisfy the relationship of equation 2, equations 1-1 and 1-2 are equivalent to rotating vectors of left channel signal L and right channel signal R.

(Equation 2)

$$W_1^2+W_2^2=1 \quad [2]$$

The relationships between rotation angle $\alpha$ and weight coefficients $W_1$ and $W_2$ in this case are shown in equations 3-1 and 3-2.

[3]

$$W_1=\cos(\alpha) \quad \text{(Equation 3-1)}$$

$$W_2=\sin(\alpha) \quad \text{(Equation 3-2)}$$

If the decoding side knows rotation angle $\alpha$, it is possible to provide $W_1$ and 1,A,$1_2$ from the relationships in equations 3-1 and 3-2. Therefore, instead of two weight coefficients $W_1$ and $W_2$, rotation angle $\alpha$ needs to be reported to the decoding side, so that, compared to a case of reporting two weight coefficients $W_1$ and $W_2$, it is possible to improve the efficiency of coding. Also, instead of rotation angle $\alpha$, it is equally possible to report one of two weight coefficients $W_1$ and $W_2$ to the decoding side. This is because two weight coefficients $W_1$ and $W_2$ satisfy the relationship in equation 2 and therefore one of these is identified when the other is identified.

Patent Literature 2 discloses a method of finding the above weight coefficients by a principal component analysis and reporting one of these two weight coefficients to the decoding side. To be more specific, a repetition method using Oja's rule is disclosed.

Further, Non-Patent Literature 1 and Non-Patent Literature 2 disclose a method of performing a principal component analysis using KL (Karhunen-Loeve) transform. To be more specific, an algorithm of finding by KL transform an rotation angle for transforming two vectors, is disclosed. For example, Non-Patent Literature 2 discloses a method of finding rotation angle $\theta$ from the power of the first signal, the power of a second signal and the correlation value of the first signal and the second signal. Rotation angle $\theta$ is derived by an algorithm of finding an eigenvector (in which the square sum of the elements is 1) by eigenvalue expansion using a two-dimensional correlation matrix. With a method of quantizing and transmitting resulting rotation angle $\theta$, it is possible to demultiplex and encode signals efficiently. As an example of quantization, there is scalar quantization using a table.

The quantization method disclosed in Non-Patent Literature 2 will be explained below.

First, using equations 4-1 to 4-3, power $C_{11}$ of input left channel signal L, power $C_{22}$ of input right channel signal R and correlation value $C_{12}$ are calculated.

(Equation 4-1)

$$C_{11}=\sum_i x_{1,i} \cdot x_{1,i} \quad [4]$$

-continued (Equation 4-2)

$$C_{22} = \sum_i x_{2,i} \cdot x_{2,i}$$

(Equation 4-3)

$$C_{12} = \sum x_{1,i} \cdot x_{2,i}$$

Further, using power $C_{11}$ and $C_{22}$ and correlation value $C_{12}$, rotation angle $\alpha$ is calculated. Non-Patent Literature 2 discloses a method of calculating a rotation angle by PCA (Principal Component Analysis), which is one method of finding KL transformation coefficients. The equation for calculating a rotation angle disclosed in Non-Patent Literature 2 is shown in equation 5.

(Equation 5)

$$\alpha = 0.5 \cdot \tan^{-1}\left[\frac{2 \cdot C_{12}}{C_{11} - C_{22}}\right] + 0 \quad [5]$$

$$(\text{when } C_{11} - C_{12} \geq 0) + \pi/2(\text{else})$$

Then, from a plurality of pairs each associating a rotation angle and a quantization code in advance, the quantization code associated with the rotation angle closest to rotation angle $\alpha$ obtained in equation 5, is reported to the decoding side. By this means, compared to a case of reporting two transformation coefficients $W_1$ and $W_2$ required upon performing a principal component analysis, it is possible to improve the efficiency of coding.

Thus, according to Non-Patent Literature 2, by quantizing a rotation angle upon transforming two vectors (signals or spectrums) into different vectors by a principal component analysis, efficient coding is performed. Also, Non-Patent Literature 1 discloses an example of using KL transformation coefficients themselves as the quantization target, instead of a rotation angle.

CITATION LIST

Patent Literature

[PTL 1]

Japanese Patent Application Laid-Open No. 2001-255892

[PTL 2]

Published Japanese Translation No. 2005-522721 of the PCT International Publication

Non-Patent Literature

[NPL 1]

Yang and others, "High-Fidelity Multichannel Audio Coding With Karhunen-Loeve Transform" IEEE Trans. Speech and Audio processing, VOL 11, No. 4, July 2003

[NPL 2]

Virette and others, "PARAMETRIC CODING OF STEREO AUDIO BASED ON PRINCIPAL COMPONENT ANALYSIS", Proc. of the Conference on Digital Audio Effects (DAFx-06), Sep. 18-20, 2006

SUMMARY OF INVENTION

Technical Problem

However, as is clear from equation 5, the quantization method disclosed in Non-Patent Literature 2 requires calculations involving divisions and trigonometric functions to calculate rotation angle $\alpha$, and therefore there is a problem that the amount of calculations is large. Also, the quantization method disclosed in Non-Patent Literature 1 has to calculate coefficients eventually by a principal component analysis, requires calculations involving divisions and square roots, and therefore has a problem that the amount of calculations is large like above Non-Patent Literature 2.

In view of the above, it is therefore an object of the present invention to provide: a quantizing apparatus that can reduce, in a case of performing stereo coding using principal component analysis transformation, the amount of calculations upon quantizing a value related to transformation coefficients in the principal component analysis transformation; an encoding apparatus that performs stereo coding using the transformation coefficients; and quantizing and encoding methods.

Solution to Problem

The quantizing apparatus of the present invention that quantizes a value related to transformation coefficients upon performing a principal component analysis transformation of a first vector signal and a second vector signal, employs a configuration having: a power and correlation calculating section that calculates power of the first vector signal, power of the second vector signal and a correlation value between the first vector signal and the second vector signal; an intermediate value calculating section that calculates, as an intermediate value, a result of performing a difference computation using the power of the first vector signal and the power of the second vector signal; a codebook that holds a plurality of pairs of a first coefficient and a second coefficient, which are related to the transformation coefficients and numbered; and a quantizing section that calculates, as a reference value, an addition result of a first multiplication result acquired by multiplying the first coefficient by the correlation value and a second multiplication value acquired by multiplying the second coefficient by the intermediate value, and, based on magnitude of the reference value, selects the number as a code.

The encoding apparatus of the present invention employs a configuration having: the above quantizing apparatus; a transforming section that obtains a monaural signal and a side signal by rotating the first vector signal and the second vector signal using the transformation coefficients associated with the code selected in the quantizing section; a first encoding section that encodes the monaural signal; and a second encoding section that encodes the side signal.

The quantizing method of the present invention of quantizing a value related to transformation coefficients upon performing a principal component analysis transformation of a first vector signal and a second vector signal, includes the steps of: calculating power of the first vector signal, power of the second vector signal and a correlation value between the first vector signal and the second vector signal; calculating, as an intermediate value, a result of performing a difference computation using the power of the first vector signal and the power of the second vector signal; and calculating, as a reference value, an addition result of a first multiplication result acquired by multiplying a first coefficient by the correlation value and a second multiplication value acquired by multiplying a second coefficient by the intermediate value, and, based on magnitude of the reference value, selecting the number as a code, the first coefficient and the second coefficient being read from a codebook that holds a plurality of pairs of the first coefficient and the second coefficient related to the transformation coefficients and numbered.

ADVANTAGEOUS EFFECTS OF INVENTION

According to the present invention, in a case of performing stereo coding using principal component analysis transformation, it is possible to obtain a quantization code associated with transformation coefficients upon performing stereo coding using principal component analysis transformation, without performing calculation processing involving trigonometric functions, divisions and so on, so that it is possible to reduce the amount of calculations upon quantizing a value related to transformation coefficients in principal component analysis transformation.

BRIEF DESCRIPTION OF DRAWINGS

FIG. 2 shows an example of a table held in a codebook provided in an encoding apparatus according to the embodiment;

FIG. 4A shows an example of a table held in a codebook provided in a decoding apparatus according to the embodiment; and FIG. 4B shows an example of a table held in a codebook provided in a decoding apparatus according to the embodiment.

DESCRIPTION OF EMBODIMENT

Now, an embodiment of the present invention will be explained below with reference to the accompanying drawings. Also, an example case will be explained with the present embodiment where two vectors received as input in a quantizing apparatus are the left channel signal and the right channel signal of a stereo signal.

Figure 1:
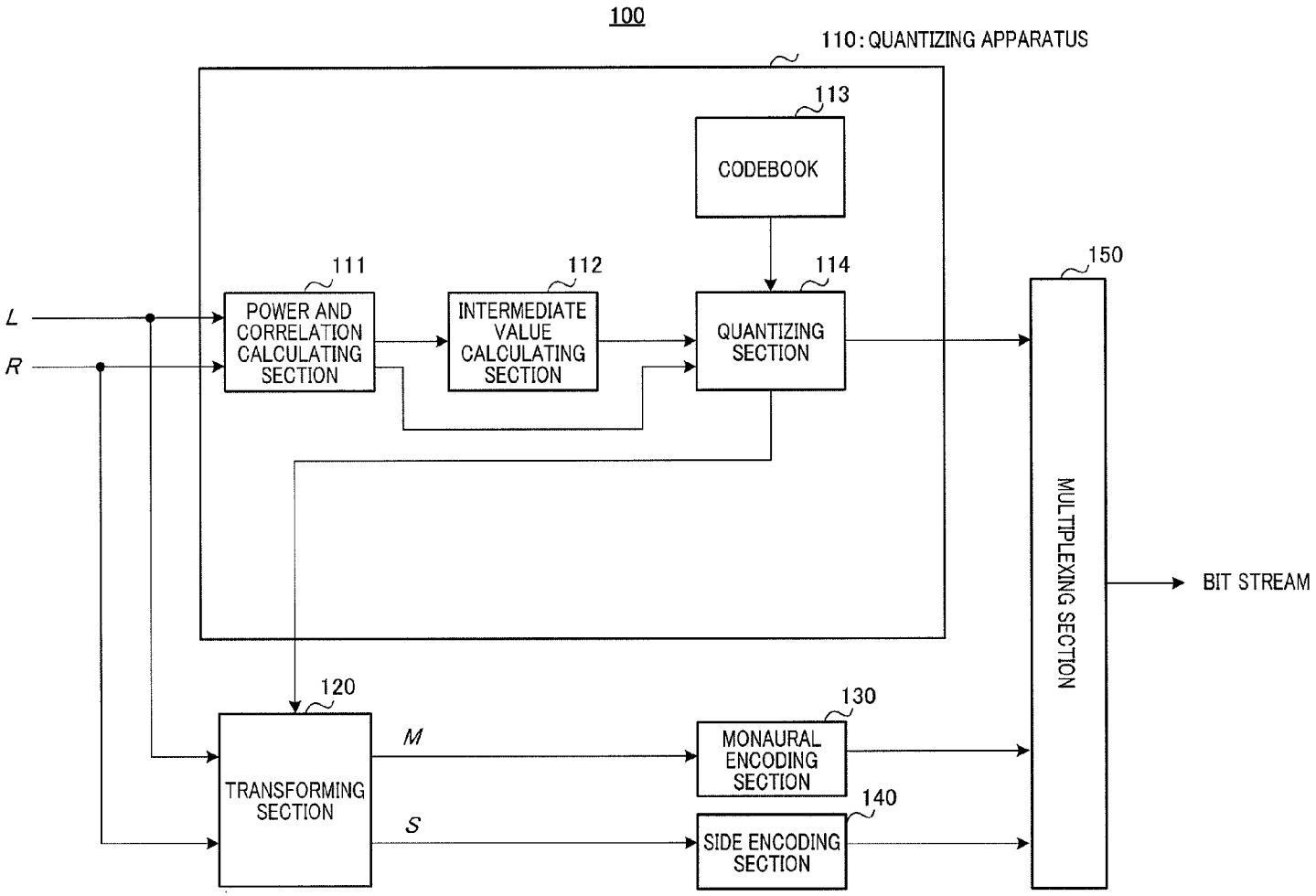
FIG. 1 is a block diagram showing a configuration of an encoding apparatus including a quantizing apparatus according to an embodiment of the present invention.

FIG. 1 is a block diagram showing main components of an encoding apparatus including a quantizing apparatus according to the present embodiment. Encoding apparatus 100 shown in FIG. 1 is mainly provided with quantizing apparatus 110, transforming section 120, monaural encoding section 130, side encoding section 140 and multiplexing section 150.

Quantizing apparatus 110 obtains transformation coefficients $W_1$ and $W_2$ used upon performing a principal component analysis in transforming section 120, from left channel signal L and right channel signal R of a stereo signal, and outputs obtained transformation coefficients $W_1$ and $W_2$ to transforming section 120. Also, quantizing apparatus 110 obtains a quantization code associated with transformation coefficients $W_1$ and $W_2$, and outputs the obtained quantization code to multiplexing section 150. Also, the configuration inside quantizing apparatus 110 will be described later.

Transforming section 120 transforms left channel signal L and right channel signal R into monaural signal M and side signal S using transformation coefficients $W_1$ and $W_2$ outputted from quantizing apparatus 110, according to equations 6-1 and 6-2.

[6]

$$y_{1,i}=W_1 \cdot x_{1,i}+W_2 \cdot x_{2,i} \quad \text{(Equation 6-1)}$$

$$y_{2,i}=-W_2 \cdot x_{1,i}+W_1 \cdot x_{2,i} \quad \text{(Equation 6-2)}$$

Also, in equations 6-1 and 6-2, $x_{1,i}$ represents left channel signal L and $x_{2,i}$ represents right channel signal R. Also, $y_{1,i}$ represents monaural signal M and $y_{2,i}$ represents side signal S. Also, i represents an index to represent time.

Then, transforming section 120 outputs monaural signal M to monaural encoding section 130 and outputs side signal S to side encoding section 140.

Monaural encoding section 130 encodes monaural signal M and outputs resulting encoded data to multiplexing section 150. Side encoding section 140 encodes side signal S and outputs resulting encoded data to multiplexing section 150.

Multiplexing section 150 multiplexes the encoded data of monaural signal M, the encoded data of side signal S and the quantization code, and outputs multiplexed bit streams.

Next, the configuration inside quantizing apparatus 110 will be explained.

Quantizing apparatus 110 is provided with power and correlation calculating section 111, intermediate value calculating section 112, codebook 113 and quantizing section 114.

Power and correlation calculating section 111 calculates power $C_{11}$ of input left channel signal L, power $C_{22}$ of input right channel signal R and correlation value $C_{12}$, using equations 7-1 to 7-3.

(Equation 7-1)

$$C_{11} = \sum_i x_{1,i} \cdot x_{1,i} \quad [7]$$

(Equation 7-2)

$$C_{22} = \sum_i x_{2,i} \cdot x_{2,i}$$

(Equation 7-3)

$$C_{12} = \sum x_{1,i} \cdot x_{2,i}$$

Power and correlation calculating section 111 outputs power $C_{11}$ and $C_{22}$ and correlation value $C_{12}$ to intermediate value calculating section 112 and outputs correlation value $C_{12}$ to quantizing section 114.

Intermediate value calculating section 112 calculates intermediate value $C_{1122}$ using power $C_{11}$ and $C_{22}$, according to equation 8, and outputs intermediate value $C_{1122}$ to quantizing section 114.

(Equation 8)

$$C_{1122}=C_{11}-C_{22} \quad [8]$$

Codebook 113 holds a plurality of pairs of coefficients $\gamma_{1,n}$ and $\gamma_{2,n}$ used in quantizing section 114. An example of a table held in codebook 113 is shown in FIG. 2. FIG. 2 shows an example of a table used in a case where coefficients $\gamma_{1,n}$ and $\gamma_{2,n}$ are subjected to scalar coding in three bits. As shown in FIG. 2, in the table, the number is assigned to each pair of coefficients $\gamma_{1,n}$ and $\gamma_{2,n}$. Also, although the values of numbers are written in binary in FIG. 2, actually, these values need not be stored in a memory, and the order of coefficients (the number indicating the order) is used as a code. Also, FIG. 2 shows an example where codebook 113 holds in advance coefficients $\gamma_{1,n}$ and $\gamma_{2,n}$ and transformation coefficients $W_1$ and $W_2$ associated with coefficients $\gamma_{1,n}$ and $\gamma_{2,n}$.

Quantizing section 114 selects coefficients $\gamma_{1,n}$ and $\gamma_2$ to maximize cost function E represented by equation 9, from codebook 113.

(Equation 9)

$$E = \sum_i y_{1,i}^2 - y_{2,i}^2 = (W_1^2 - W_2^2)(C_{11} - C_{22}) + 4W_1W_2C_{12} = \gamma_{1,n} \cdot C_{1122} + \gamma_{2,n} \cdot C_{12} \quad [9]$$

Further, quantizing section 114 outputs the number of selected coefficient $\gamma_{1,n}$ and coefficient $\gamma_{2,n}$ to multiplexing section 150 as a code (quantization code). Also, quantizing section 114 outputs transformation coefficients $W_1$ and $W_2$ associated with selected coefficients $\gamma_{1,n}$ and $\gamma_{2,n}$ to transforming section 120.

For example, if cost function E in equation 9 is maximized in a case where the relationship of $(\gamma_{1,n},\gamma_{2,n})$=(g31,g32) holds between coefficients $\gamma_{1,n}$ and $\gamma_{2,n}$, quantizing section 114 selects the number "010" associated with the above pair of coefficients $\gamma_{1,n}$ and $\gamma_{2,n}$, as a quantization code, and outputs this number to multiplexing section 150. Also, quantizing section 114 outputs transformation coefficients $(W_1,W_2)$=(Ω31,ω32) associated with the selected quantization code "010" to transforming section 120.

The relationship between coefficients $\gamma_{1,n}$ and $\gamma_{2,n}$ and transformation coefficients $W_1$ and $W_2$ will be explained below.

As described above, transforming section 120 transforms left channel signal L and right channel signal R into monaural signal M and side signal S using equations 6-1 and 6-2. Thus, transforming section 120 performs a KL transformation. Here, KL transformation coefficients and rotation angle α have the relationships of equations 10-1 and 10-2. Therefore, $W_1$ and $W_2$ satisfy equation 10-3.

[10]

$$W_1=\cos(\alpha) \quad \text{(Equation 10-1)}$$

$$W_2=\sin(\alpha) \quad \text{(Equation 10-2)}$$

$$W_1^2+W_2^2=1 \quad \text{(Equation 10-3)}$$

Cost function E represented by equation 9 can be rewritten to an equation using only KL transformation coefficient $W_1$ using equation 10-3, as shown in equation 11.

(Equation 11)

$$E=(2W_1^2-1)(C_{11}-C_{22})+4W_1\sqrt{1-W_1^2}C_{12} \quad [11]$$

Here, by partially differentiating above equation 11 by $W_1$, equation 12 is obtained.

(Equation 12)

$$\frac{1}{4} \cdot \frac{\partial E}{\partial W_1} = W_1(C_{11} - C_{22}) + \frac{(1 - 2 \cdot W_1^2)}{\sqrt{1 - W_1^2}} C_{12} \quad [12]$$

Further, by substituting equation 10-1 into the right side member of above equation 12 and multiplying both members of above equation 12 by sin(α), equation 13 is obtained.

(Equation 13)

$$\frac{\sin(\alpha)}{4} \cdot \frac{\partial E}{\partial W_1} = \frac{\partial E'}{\partial W_1} = \frac{1}{2}\sin(2\alpha) \cdot (C_{11} - C_{22}) - \cos(2\alpha) \cdot C_{12} \quad [13]$$

As described above, with the present embodiment, quantizing section 114 selects coefficients and $\gamma_{1,n}$ and $\gamma_{2,n}$ to maximize cost function E represented by equation 9. This is equivalent to a case where coefficients $\gamma_{1,n}$ and $\gamma_{2,n}$ to make equation 13 "0" are selected.

Here, if equation 5 is substituted into equation 13, equation 13 is "0." The present inventors focused on this point. That is, cost function E has an extreme value with respect to transformation coefficient $W_1$, and is maximized in the case of rotation angle α obtained from equation 5. Therefore, performing a KL transformation using transformation coefficients $W_1$ and $W_2$ associated with coefficients $\gamma_{1,n}$ and $\gamma_{2,n}$ to maximize the cost function, is equivalent to substituting rotation angle α obtained from equation 5 into equations 10-1 and 10-2, calculating transformation coefficients $W_1$ and $W_2$ and performing a KL transformation. Therefore, quantizing and reporting rotation angle α to the decoding side is theoretically equivalent to quantizing and reporting coefficients $\gamma_{1,n}$ and $\gamma_{2,n}$ to maximize cost function E, to the decoding side.

The present embodiment quantizes and reports coefficients $\gamma_{1,n}$ and $\gamma_{2,n}$ to the decoding side. Therefore, codebook 113 is designed to associate coefficients $\gamma_{1,n}$ and $\gamma_{2,n}$ with a quantization code and hold these.

Also, the relationships of equations 14-1 and 14-2 hold between coefficients $\gamma_{1,n}$ and $\gamma_{2,n}$ and rotation angle α, so that the decoding side can associate coefficients $\gamma_{1,n}$ and $\gamma_{2,n}$ with rotation angle α on a one-to-one basis via a quantization code.

[14]

$$\gamma_{1,n}=\cos(2\alpha_n) \quad \text{(Equation 14-1)}$$

$$\gamma_{2,n}=2\cdot\sin(2\alpha_n) \quad \text{(Equation 14-2)}$$

Thus, quantizing section 114 selects a quantization code associated with coefficients $\gamma_{1,n}$ and $\gamma_{2,n}$ to maximize cost function E represented by equation 9. By this means, it is possible to obtain a quantization code associated with transformation coefficients upon performing stereo coding using principal component analysis transformation, without performing calculation processing involving trigonometric functions, divisions and so on, so that it is possible to reduce the amount of calculations for quantization.

Also, from equation 9, the relationships of equations 15-1 and 15-2 hold between coefficients $\gamma_{1,n}$ and $\gamma_{2,n}$ and transformation coefficients $W_1$ and $W_2$, and, consequently, codebook 113 is designed to hold transformation coefficients $W_1$ and $W_2$ associated with coefficients $\gamma_{1,n}$ and $\gamma_{2,n}$ in a table form. By this means, quantizing section 114 can easily obtain transformation coefficients $W_1$ and $W_2$ associated with selected coefficients $\gamma_{1,n}$ and $\gamma_{2,n}$ and does not require calculations for coefficients $W_1$ and $W_2$, so that it is possible to further reduce the amount of calculations required for principal component analysis.

[15]

$$\gamma_{1,n}=W_1^2-W_2^2 \quad \text{(Equation 15-1)}$$

$$\gamma_{2,n}=4W_1W_2 \quad \text{(Equation 15-2)}$$

Next, the decoding apparatus according to the present embodiment will be explained.

Figure 3:
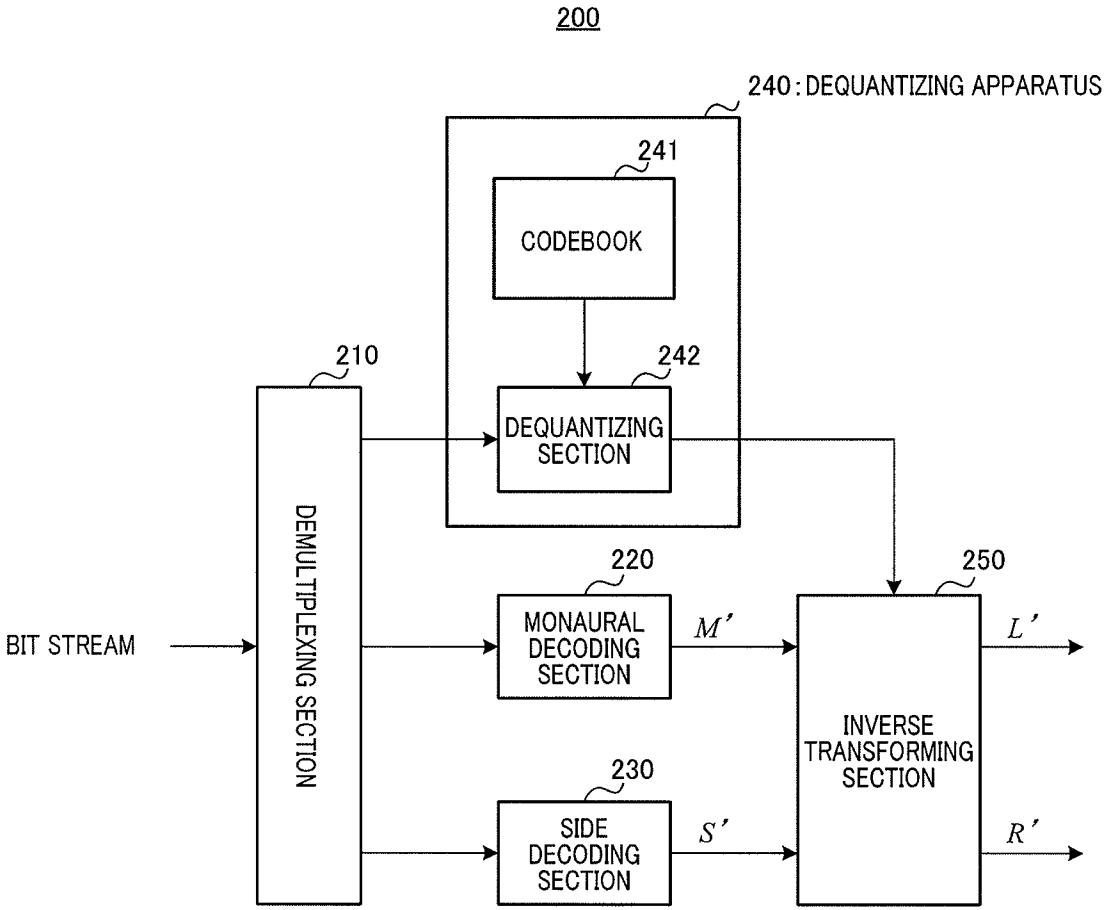
FIG. 3 is a block diagram showing a configuration of a decoding apparatus according to the embodiment.

FIG. 3 is a block diagram showing the main components of the decoding apparatus that decodes bit streams transmitted from encoding apparatus 100 according to the present embodiment. Decoding apparatus 200 shown in FIG. 3 is mainly provided with demultiplexing section 210, monaural decoding section 220, side decoding section 230, dequantizing apparatus 240 and inverse transforming section 250.

Demultiplexing section 210 demultiplexes bit streams into encoded data of monaural signal M, encoded data of side signal S and a quantization code. Then, demultiplexing section 210 outputs the encoded data of monaural signal M to monaural decoding section 220, the encoded data of side signal S to side decoding section 230 and the quantization code to dequantizing apparatus 240.

Monaural decoding section 220 decodes the encoded data of monaural signal M and outputs resulting reconstructed monaural signal M' to inverse transforming section 250.

Side decoding section 230 decodes the encoded data of side signal S and outputs resulting reconstructed side signal S' to inverse transforming section 250.

Dequantizing apparatus 240 calculates weight coefficients $W_1$ and $W_2$ from rotation angle $\alpha$ associated with the quantization code, and outputs resulting weight coefficients $W_1$ and $W_2$ to inverse transforming section 250. Also, the configuration inside dequantizing apparatus 240 will be described later.

Inverse transforming section 250 obtains reconstructed left channel signal L' and reconstructed right channel signal R' from equations 16-1 and 16-2, using weight coefficients $W_1$ and $W_2$, reconstructed monaural signal M' and reconstructed side signal S'.

[16]

$$x'_{1,1}=W_1 \cdot y'_{1,i}-W_2 \cdot y'_{2,i} \quad \text{(Equation 16-1)}$$

$$x'_{2,i}=W_2 \cdot y'_{1,i}+W_1 \cdot y'_{2,i} \quad \text{(Equation 16-2)}$$

Also, in equations 16-1 and 16-2, $x'_{1,i}$ represents reconstructed left channel signal L' and $x'_{2,i}$ represents reconstructed right channel signal R'. Also, $y'_{1,i}$ represents reconstructed monaural signal M' and $y'_{2,i}$ represents reconstructed side signal S'. Also, i represents an index to represent time.

Next, the configuration inside dequantizing apparatus 240 will be explained.

Dequantizing apparatus 240 is provided with codebook 241 and dequantizing section 242.

Codebook 241 holds a plurality of pairs of a rotation angle and a quantization code. FIG. 4A shows an example of a table held in codebook 241. FIG. 4A shows an example of a table used in a case where rotation angles are subjected to scalar coding in three bits. As shown in FIG. 4A, the table associates rotation angles and quantization codes.

Also, as described above, the relationships of equations 14-1 and 14-2 hold coefficients $\gamma_{1,n}$ and $\gamma_{2,n}$ and rotation angle $\alpha$, and, consequently, the table associates rotation angles and quantization codes such that coefficients $\gamma_{1,n}$ and $\gamma_{2,n}$ and rotation angle $\alpha$ are associated on a one-to-one basis via a quantization code.

Dequantizing section 242 selects rotation angle $\alpha$ associated with a quantization code, calculates weight coefficients $W_1$ and $W_2$ using selected rotation angle $\alpha$ and equations 17-1 and 17-2, and outputs resulting weight coefficients $W_1$ and $W_2$ to inverse transforming section 250.

[17]

$$W_1=\cos(\alpha) \quad \text{(Equation 17-1)}$$

$$W_2=\sin(\alpha) \quad \text{(Equation 17-2)}$$

Also, codebook 241 holds in advance transformation coefficients $W_1$ and $W_2$ associated with rotation angles $\alpha 1$ to $\alpha 8$, and, if dequantizing apparatus 240 outputs transformation coefficients $W_1$ and $W_2$ associated with a quantization code to inverse transforming section 250, inverse quantizing section 250 can eliminate calculations in equations 17-1 and 17-2. FIG. 4B shows an example of a table associating quantization codes, rotation angles $\alpha 1$ to $\alpha 8$ and transformation coefficients $W_1$ and $W_2$.

As described above, the present embodiment selects the quantization code associated with coefficients $\gamma_{1,n}$ and $\gamma_{2,n}$ to maximize the cost function E represented by equation 9. By this means, it is possible to obtain a quantization code associated with transformation coefficients upon performing stereo coding using principal component analysis transformation, without performing calculation processing involving trigonometric functions, divisions and so on, so that it is possible to reduce the amount of calculations for quantization.

Also, on the encoding side and decoding side, by associating coefficients $\gamma_{1,n}$ and $\gamma_{2,n}$ satisfying the relationships of equations 14-1 and 14-2 and rotation angle $\alpha$ with the same quantization code, similar to the prior art, a quantization code associated with rotation angle $\alpha$ is reported to the decoding side, so that it is possible to use a conventional decoding apparatus without changing a configuration on the decoding side.

Also, although a case has been described with the above explanation where codebook 113 holds a table associating quantization codes and transformation coefficients $W_1$ and $W_2$ for those quantization codes and quantizing section 114 outputs transformation coefficients $W_1$ and $W_2$ to transforming section 120, the present invention is not limited to this. For example, a case is possible where codebook 113 holds a table associating coefficients $\gamma_{1,n}$ and $\gamma_{2,n}$ and quantization codes and where transforming section 120 holds a table associating quantization codes and transformation coefficients $W_1$ and $W_2$ for those quantization codes. In this case, quantizing section 114 may output a quantization code associated with coefficients $\gamma_{1,n}$ and $\gamma_{2,n}$ to maximize cost function E represented by equation 9, to transforming section 120, and transforming section 120 may perform a principal component analysis transformation using transformation coefficients $W_1$ and $W_2$ for that quantization code.

Also, inverse transforming section 250 may hold a table associating quantization codes and transformation coefficients $W_1$ and $W_2$ for those quantization codes.

Demonstration experiments have been conducted to verify the effects of the present invention. As a result, it was verified that, if the number of quantization bits for KL transformation coefficients is around four bits, it is possible to realize quantization with a significantly less amount of calculations, which is about two-fifths of the calculation amount in the method of Non-Patent Literature 2.

Also, sound decoded in a conventional decoding apparatus merely shows a little difference in a few samples as conventional decoded sound and digital data, and, consequently, it was verified that the encoding method according to the present embodiment does not lose conventional features theoretically at all.

The reason that the above significant effect is obtained is that the present embodiment does not perform computations with a large amount of calculations such as a trigonometric function (about 25 steps), division (about 18 steps) and square root (about 25 steps) and the codebook is relatively small (four bits; sixteen kinds).

Also, although two stereo signals are expressed by the names "left channel signal" and "right channel signal" in the above embodiments, it is equally possible to use more general names such as "first channel signal" and "second channel signal" or "first vector signal" and "second vector signal."

Although cases have been described above with embodiments where an input vector of the quantizing apparatus is a signal on the time axis, with the present invention, it is equally possible to use a frequency spectrum on the frequency axis as an input vector. Also, it is equally possible to use a partial interval of a signal on the time axis or the frequency axis as an input vector. This is because the present invention does not depend on vector characteristics such as a vector type.

Also, example cases have been described above where the decoding apparatus according to the present embodiment receives and processes bit streams transmitted from the encoding apparatus according to the above embodiments. However, the present invention is not limited to this, and it is equally possible to use bit streams to be received and processed in the decoding apparatus according to the above embodiments as long as these bit streams are transmitted from an encoding apparatus that can generate bit streams that can processed in the decoding apparatus according to the above embodiments.

Also, although cases have been described above with embodiments where encoded information is transmitted from the encoding side to the decoding side, the present invention is equally effective to a case where information encoded on the encoding side is stored in a storage medium. There are many cases where audio signals are accumulated and used in a memory or disk, and the present invention is equally effective to these cases. Also, it is equally possible to print encoded information on media such as a printing code and read out the printed, encoded information on the decoding side.

Also, although cases have been described above with embodiments where two channels are used, the number of channels is not limited, and the present invention is equally effective in the case where many channels (e.g. 5.1 channels) are used. In this case, if channels having temporally different correlation with a fixed channel are identified, the present invention is directly applicable to this case.

Also, the above explanation is an example of the best mode for carrying out the present invention, and the scope of the present invention is not limited to this. The present invention is applicable to any systems as long as these systems include an encoding apparatus and a decoding apparatus.

Also, the encoding apparatus and the decoding apparatus according to the present invention can be mounted on a communication terminal apparatus and base station apparatus in a mobile communication system, so that it is possible to provide a communication terminal apparatus, base station apparatus and mobile communication system having the same operational effect as above.

Although a case has been described above with the embodiment as an example where the present invention is implemented with hardware, the present invention can be implemented with software.

For example, by describing the algorithm according to the present invention in a programming language, storing this program in a memory and running this program by an information processing section, it is possible to implement the same function as the encoding apparatus according to the present invention.

Furthermore, each function block employed in the description of each of the aforementioned embodiment may typically be implemented as an LSI constituted by an integrated circuit. These may be individual chips or partially or totally contained on a single chip.

"LSI" is adopted here but this may also be referred to as "IC," "system LSI," "super LSI," or "ultra LSI" depending on differing extents of integration.

Further, the method of circuit integration is not limited to LSI's, and implementation using dedicated circuitry or general purpose processors is also possible. After LSI manufacture, utilization of an FPGA (Field Programmable Gate Array) or a reconfigurable processor where connections and settings of circuit cells in an LSI can be regenerated is also possible.

Further, if integrated circuit technology comes out to replace LSI's as a result of the advancement of semiconductor technology or a derivative other technology, it is naturally also possible to carry out function block integration using this technology. Application of biotechnology is also possible.

The disclosure of Japanese Patent Application No. 2008-161020, filed on Jun. 19, 2008, including the specification, drawings and abstract, is incorporated herein by reference in its entirety.

INDUSTRIAL APPLICABILITY

The quantizing apparatus, encoding apparatus, and quantizing and encoding methods according to the present invention are suitably used for mobile phones, IP telephones, television conference, and so on.

REFERENCE SIGNS LIST

100 encoding apparatus
110 quantizing apparatus
120 transforming section
130 monaural encoding section
140 side encoding section
150 multiplexing section
111 power and correlation calculating section
112 intermediate value calculating section
113, 241 codebook
114 quantizing section
200 decoding apparatus
210 demultiplexing section
220 monaural decoding section
230 side decoding section
240 dequantizing apparatus
242 dequantizing section
250 inverse transforming section

The invention claimed is:

1. A quantizing apparatus that quantizes a value related to transformation coefficients upon performing a principal component analysis transformation of a first vector signal and a second vector signal, the apparatus comprising: at least one processor and memory;

a power and correlation calculator that calculates power of the first vector signal, power of the second vector signal and a correlation value between the first vector signal and the second vector signal;

an intermediate value calculator that calculates, as an intermediate value, a result of performing a difference computation using the power of the first vector signal and the power of the second vector signal;

a codebook that holds a plurality of numbered pairs of a first coefficient and a second coefficient, which are related to the transformation coefficients; and a quantizer that calculates, as a reference value, an addition result of a first multiplication result acquired by multiplying the first coefficient by the correlation value and a second multiplication value acquired by multiplying the second coefficient by the intermediate value, and, based on magnitude of the reference value, selects an index number of a numbered pair of a first coefficient and a second coefficient in the codebook as a code.

2. The quantizing apparatus according to claim 1, wherein the quantizer selects, as the code, the number associated with a pair of the first coefficient and the second coefficient to maximize the reference value.

3. The quantizing apparatus according to claim 1, wherein the first coefficient is represented by equation 1 using rotation angle a associated with the transformation coefficients, and the second coefficient is represented by equation 2

$$\gamma_1=\cos(2\alpha) \quad \text{(Equation 1)}$$

$$\gamma_2=2\cdot\sin(2\alpha) \quad \text{(Equation 2)}$$

where $\gamma_1$ represents the first coefficient and $\gamma_2$ represents the second coefficient.

4. An encoding apparatus comprising:

the quantizing apparatus according to claim 1;

a transformer that obtains a monaural signal and a side signal by rotating the first vector signal and the second vector signal using the transformation coefficients associated with the code selected in the quantizer;

a first encoder that encodes the monaural signal; and a second encoder that encodes the side signal.

5. A quantizing method of comprising quantizing a pair of coefficient values related to transformation coefficients, wherein the transformation coefficients are determined upon performing a principal component analysis transformation of a first channel signal and a second vector channel signal of a stereo audio signal and quantizing pair of coefficient values related to transformation coefficients, the method comprising:

calculating power of the first vector channel signal, power of the second channel signal and a correlation value between the first vector channel signal and the second channel signal;

calculating, as an intermediate value, a result of performing a difference computation between the power of the first vector channel signal and the power of the second channel signal;

calculating, as a reference value, an addition result of a first multiplication result acquired by multiplying a first coefficient by the correlation value and a second multiplication value acquired by multiplying a second coefficient by the intermediate value, at least one of the calculating being performed by a processor; and selecting, based on a magnitude of the reference value, an index number as a quantization code, the first coefficient and the second coefficient being read from a codebook that holds a plurality of pairs of the first coefficient and the second coefficient related to the transformation coefficients and numbered according to index numbers.

* * * * *